United States Patent [19]

Kirby

[11] Patent Number: 4,564,801

[45] Date of Patent: Jan. 14, 1986

[54] SEMICONDUCTOR MOUNTED ON A YOKE IN HEAT TRANSFER RELATIONSHIP

[75] Inventor: David Kirby, Emmaus, Pa.

[73] Assignee: Lutron Electronics Co., Inc., Coopersburg, Pa.

[21] Appl. No.: 728,338

[22] Filed: Apr. 29, 1985

Related U.S. Application Data

[62] Division of Ser. No. 525,129, Aug. 22, 1983, Pat. No. 4,520,306.

[51] Int. Cl.[4] ..... H05B 39/04

[52] U.S. Cl. ..... 323/324; 323/905; 361/387

[58] Field of Search ..... 315/194, 199, DIG. 4; 323/324, 327, 905; 307/140; 338/172, 173; 361/387

[56] References Cited

U.S. PATENT DOCUMENTS

| | | | |
|---|---|---|---|
| Re. 26,119 | 12/1966 | Slater | 323/905 |
| 3,058,020 | 10/1962 | Balan | 323/905 |
| 3,935,505 | 1/1976 | Spiteri | 323/905 |
| 3,949,347 | 4/1976 | Gilbreath | 338/172 |
| 4,068,289 | 1/1978 | Ferrigno | 361/387 |
| 4,090,167 | 5/1978 | Walker et al. | 338/172 |

FOREIGN PATENT DOCUMENTS

| | | | |
|---|---|---|---|
| 2050837 | 4/1972 | Fed. Rep. of Germany | 361/387 |
| 2516006 | 11/1975 | Fed. Rep. of Germany | 361/387 |

*Primary Examiner*—William H. Beha, Jr.

*Attorney, Agent, or Firm*—Ostrolenk, Faber, Gerb & Soffen

[57] ABSTRACT

A dimmer switch assembly consists of a conductive yoke which has two insulation housings connected thereto which carry respective subassemblies for the dimmer switch. A cavity in the first housing receives the main power semiconductor device of the dimmer switch. The power semiconductor device is thermally connected to the yoke through a thin electrically insulative tape and has an active, non-electrically isolated, heat sink. A biasing spring within the first housing presses the power semiconductor device toward mechanical engagement with the yoke. The first housing assembly is fastened to the yoke by conductive eyelets which are insulated from the power semiconductor by the first insulation housing.

7 Claims, 44 Drawing Figures

FIG. 1.
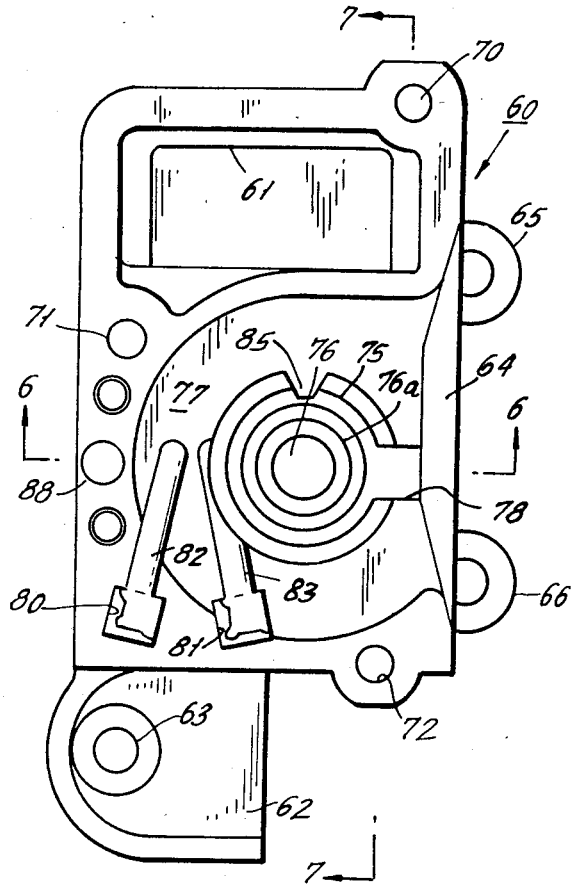
FIG. 7.
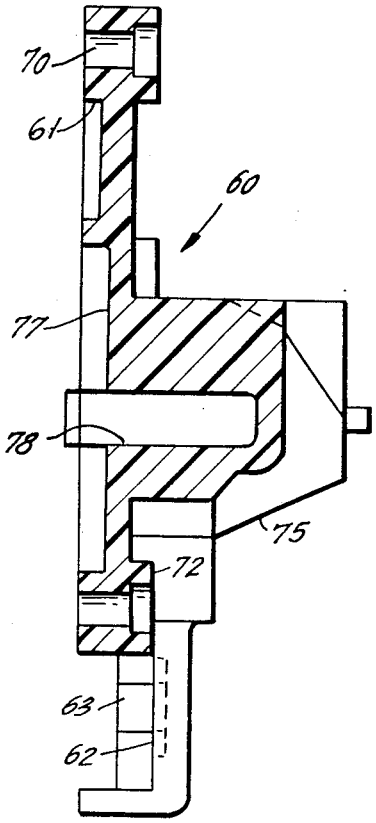
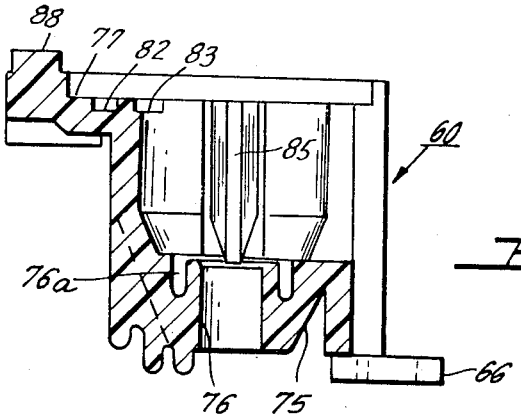
FIG. 6.

FIG. 14.
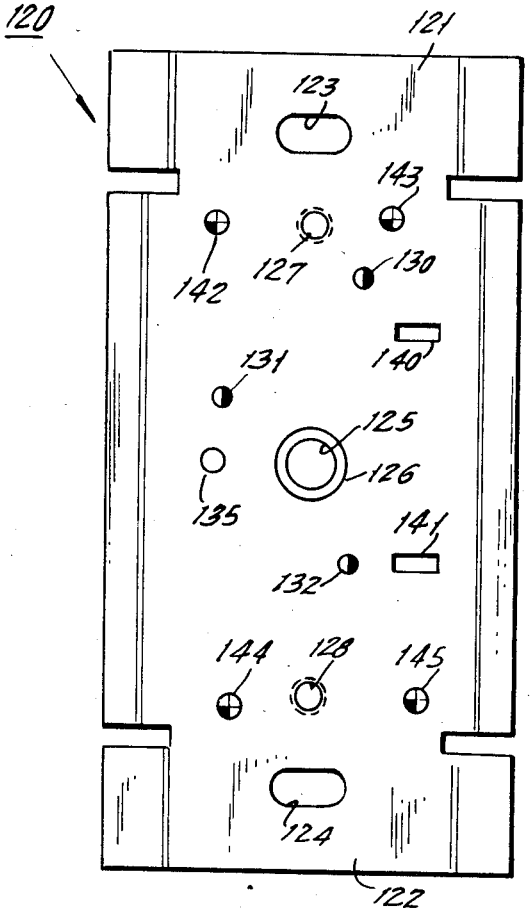
FIG. 15.
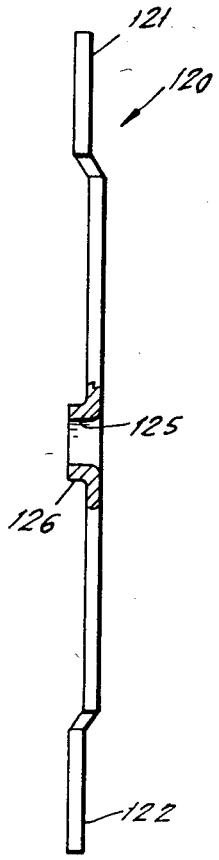
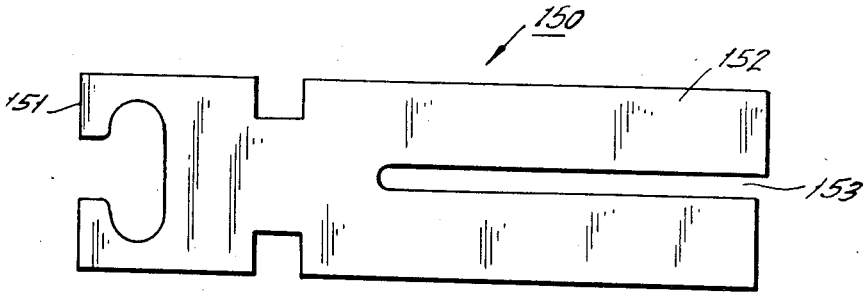
FIG. 16.
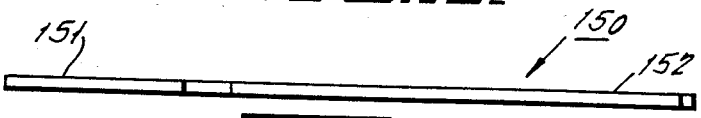
FIG. 17.

FIG. 20.
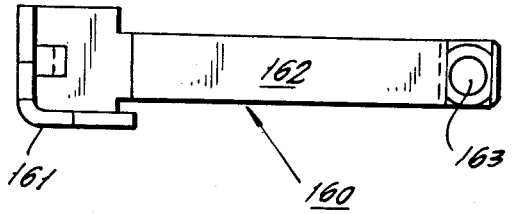
FIG. 18.
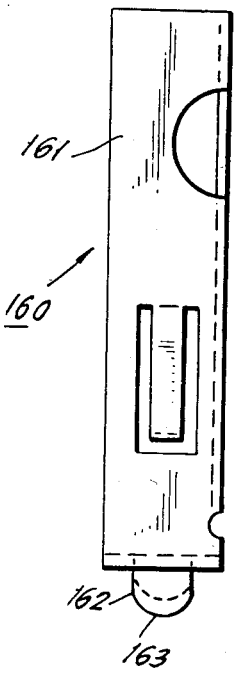
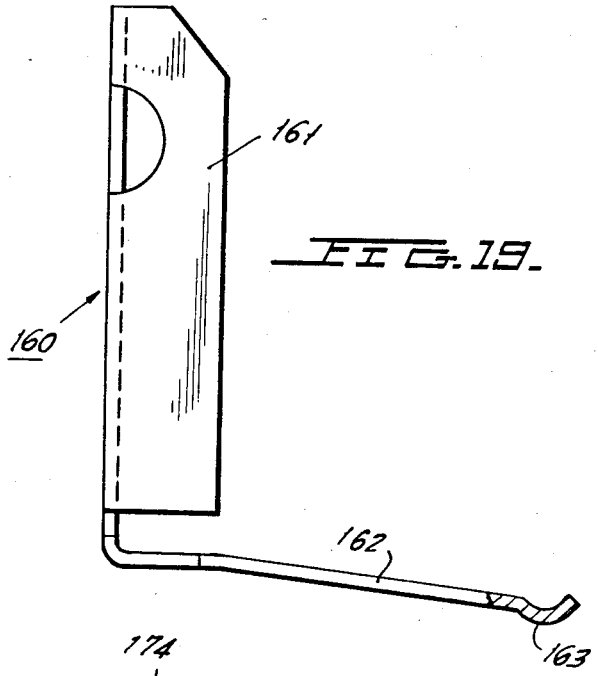
FIG. 19.
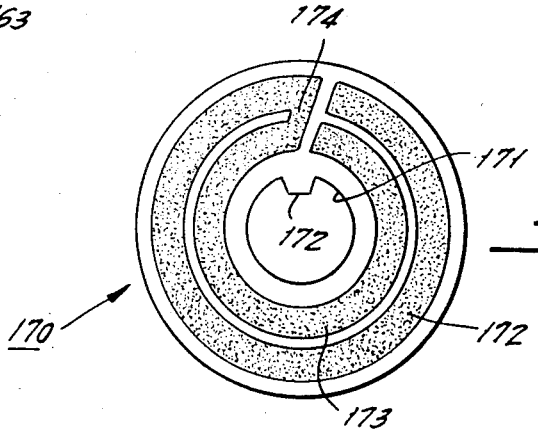
FIG. 21.

FIG. 23.
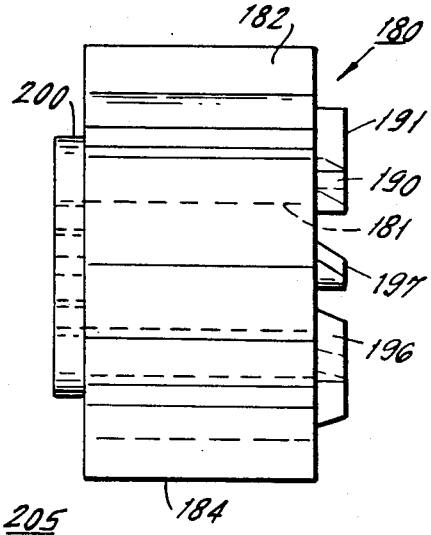
FIG. 22.
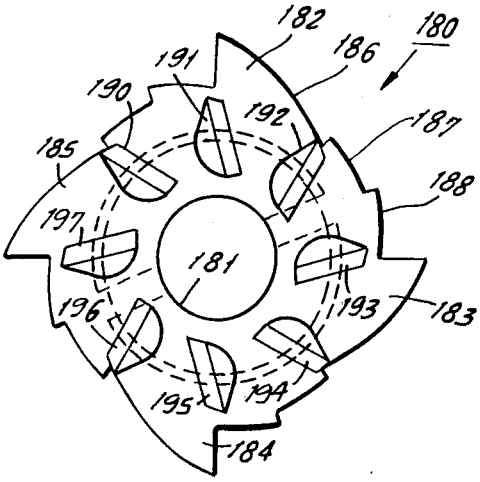
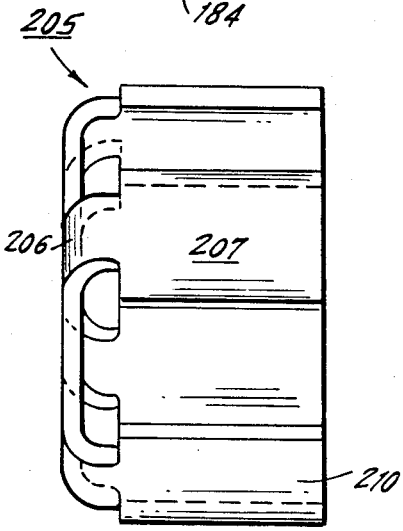
FIG. 26.
FIG. 25.
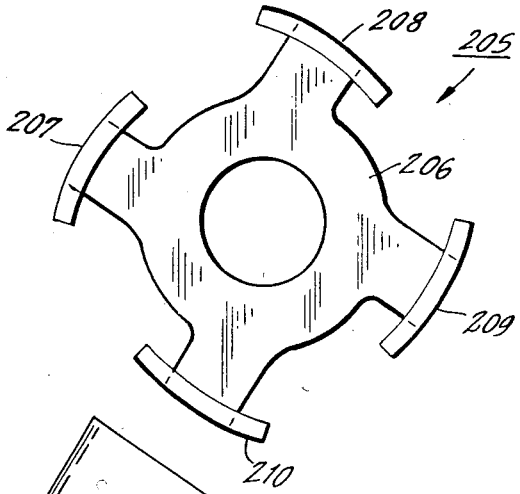
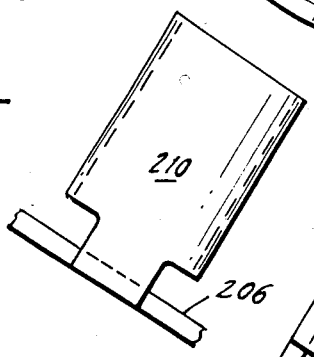
FIG. 27.
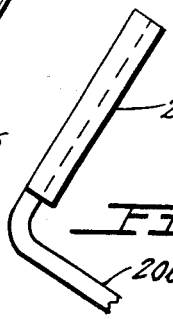
FIG. 28.
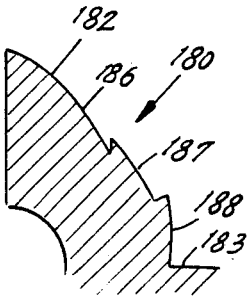
FIG. 24.

FIG. 35
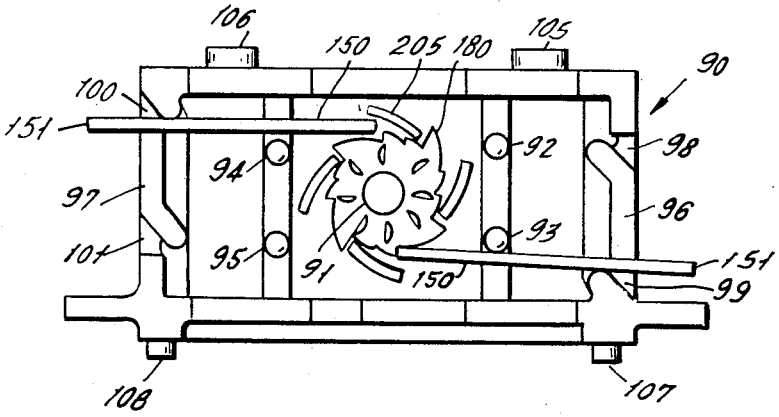
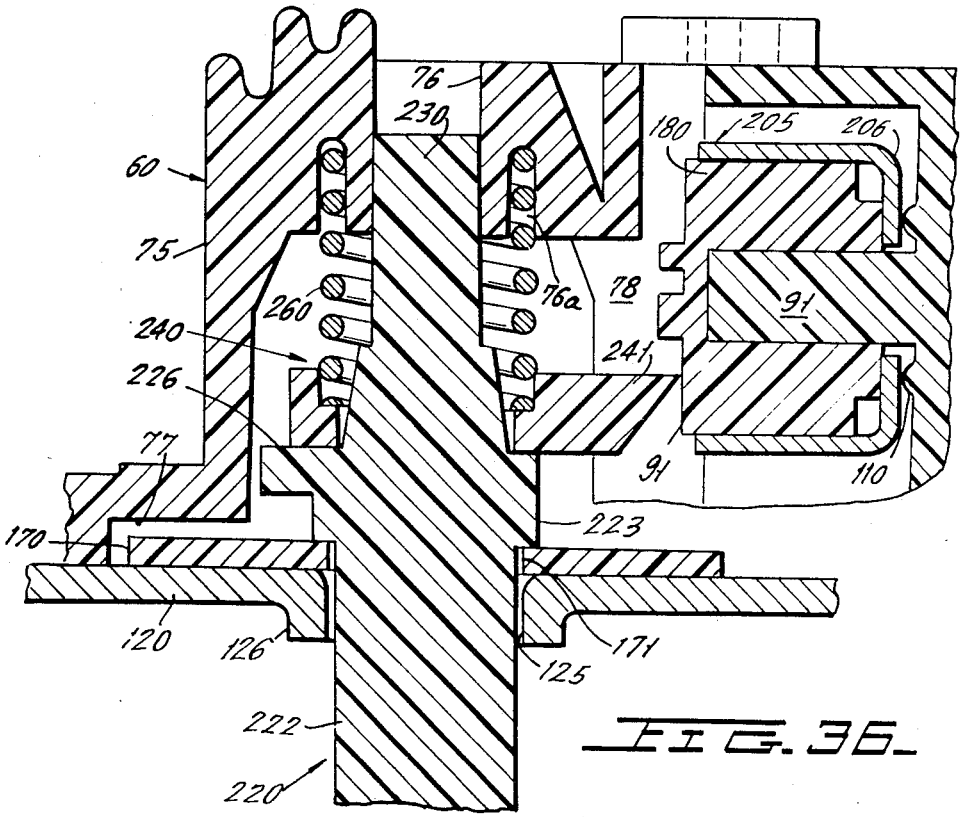
FIG. 36

FIG. 38.
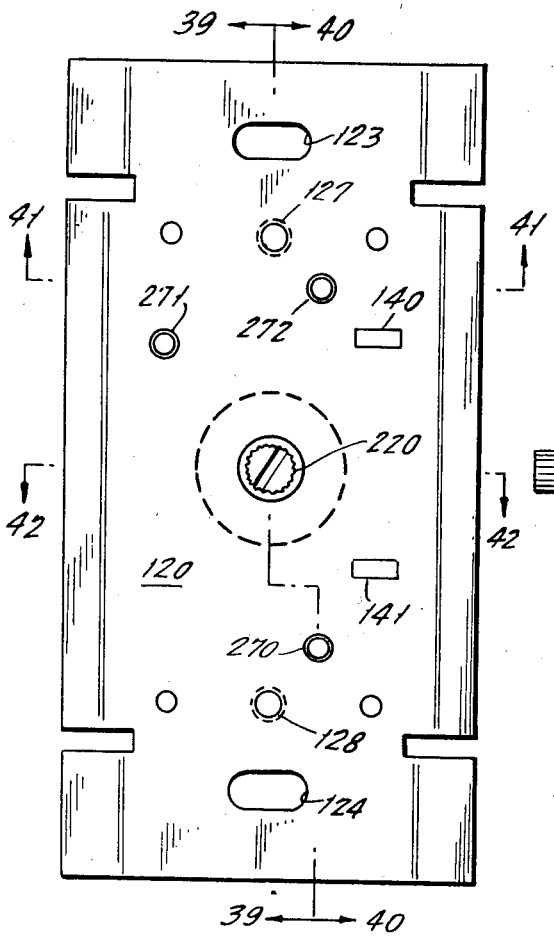
FIG. 39.
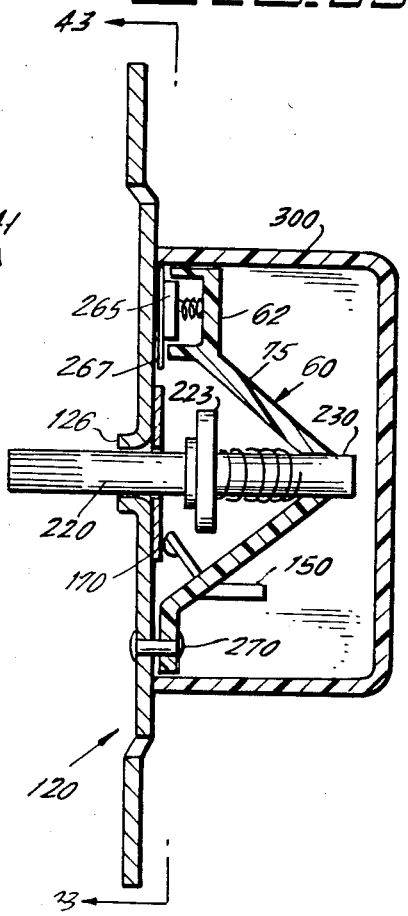
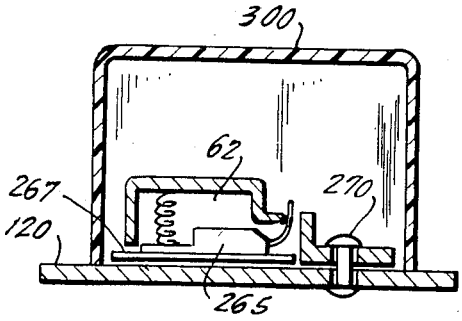
FIG. 41.
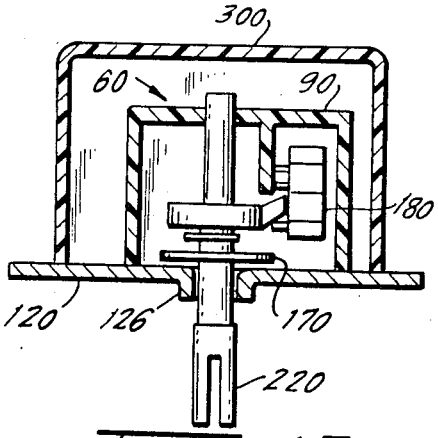
FIG. 42.

FIG. 43.
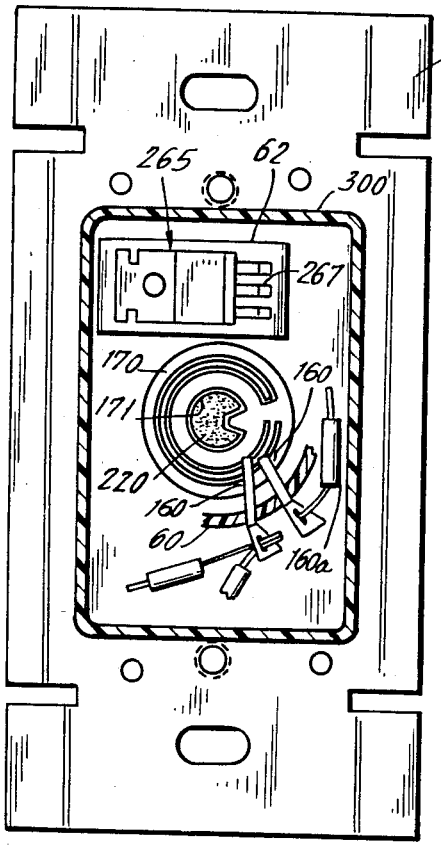
FIG. 40.
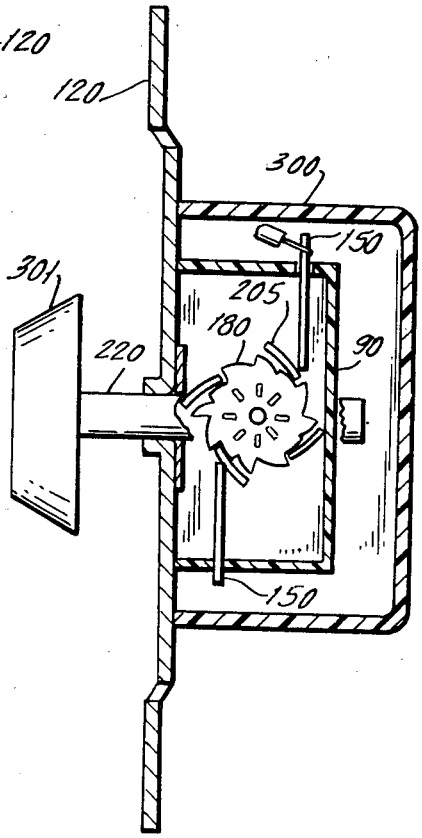
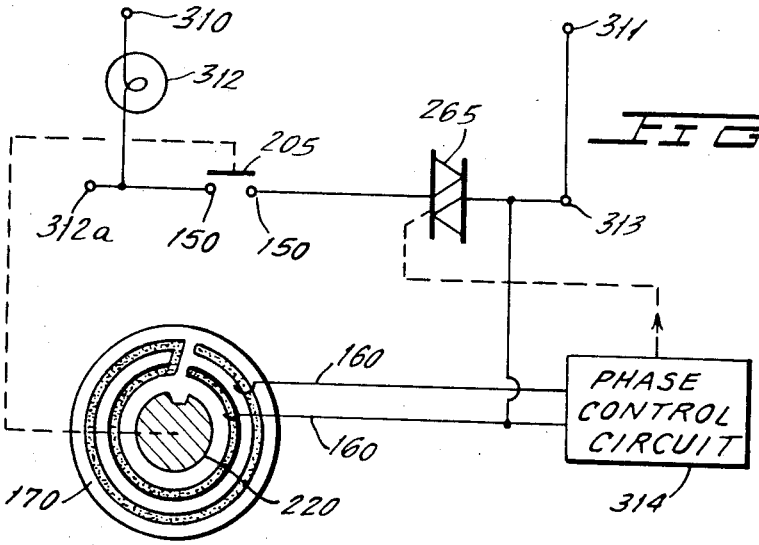
FIG. 44.

SEMICONDUCTOR MOUNTED ON A YOKE IN HEAT TRANSFER RELATIONSHIP

This is a division of application Ser. No. 525,129, filed Aug. 22, 1983, now 4,520,306.

BACKGROUND OF THE INVENTION

This invention relates to voltage control devices and more specifically relates to a novel voltage control device which can be employed as a dimmer switch or fan speed control and which can be mounted in a conventional wall box.

Lamp dimmer switches are well known and commonly employ an operating shaft which can be pushed inwardly to electrically operate an air gap switch and can be rotated to cause the dimming of an output lamp which is operated by the switch. Such devices are commonly mounted within a conventional residential wall box and employ a power semiconductor circuit which regulates by phase control caused by adjustment of a resistor by rotation of the dimmer switch shaft.

Switches of the above type are commonly manufactured by separately mounting the various switch components directly on the conductive mounting plate or yoke of the switch with the component leads and terminals holding the parts in place and serving as points of electrical connection. Electrical insulating tape or tubing is commonly used to provide electrical isolation where necessary.

Dimmer switches of the above type have been simplified in construction and assembly through the use of a molded support which receives a control potentiometer and various electronic parts and a subassembled switch mechanism. This allows simpler assembly and reduces cost because the switch has become an integral part of the molded support structure.

It is also known to employ metal eyelets or rivets to fasten the main power semiconductor device to the yoke. Arrangements of this type also allow for fewer parts and simpler assembly of the dimmer switch. In such arrangements, however, the silicon chip in the semiconductor device must be electrically insulated from its heat sink tab since the metal eyelet used as the mounting member would otherwise short the device to the mounting plate. Such semiconductor devices are relatively expensive, and have reduced thermal heat transfer characteristics, which leads to reduced service life.

BRIEF DESCRIPTION OF THE INVENTION

In accordance with the present invention, a novel and inexpensive dimmer type switch structure is provided in which a minimum number of parts are employed, and in which parts are subassembled within a two-component molded housing which is easily fixed to the metal mounting plate or yoke during final assembly. Metallic eyelets are used to secure the insulating housing sections to the metal mounting plate while a relatively inexpensive triac which has an electrically active heat sink tab is clamped directly to the metal mounting plate and is pressed into thermal engagement with the yoke by a suitable biasing spring. A thin, non-conductive tape is interposed between the semiconductor active heat sink tab and the plate. The metal eyelets are insulated from other electrically active parts other than the yoke by being recessed into the insulation housing.

A portion of the insulation housing is also used as a support for a rotatable resistor pattern plate which is fixed to the rotatable and depressible operating shaft. The resistor plate rotates relative to two fixed sliding contacts. By employing fixed slider contacts for an adjustment potentiometer or rheostat, the resistor terminal points can also serve as the connection points for the main power leads of the dimmer switch. The adjustment resistor device is hereinafter interchangeably referred to as a rheostat or potentiometer device or associated housing and these terms are intended to encompass any desired variable resistance structure. Thus, the rheostat has a novel and simplified design of relatively few parts, wherein the resistor contacts can also serve the function of the output terminals for the device.

A switching device is also employed which is contained within its own respective insulation housing and consists of an indexing cam which carries a conductive spider on portions of the lobes of the indexing cam. The cam is operated from a front surface thereof by a collar which is moved axially with the depressible operating shaft so that with each depression of the operating shaft, the index cam is rotated one cam index position. Spring contacts fixed to the index cam housing alternately engage and disengage alternate spider sections upon each subsequent depression of the operating shaft to sequentially open and close the switch with each depression of the operating shaft.

The two insulation housings are then provided with keying means to enable their automatic alignment with one another and with the mounting yoke such that three conductive eyelet fix all subassemblies in place, and automatically align the collar in the potentiometer or rheostat housing with the cam in the switch housing, by means of an access opening between the potentiometer or rheostat housing and the switch housing.

As a result of the novel coupling and the employment of two insulation housings, one for the switch mechanism and the other for the potentiometer mechanism, an extremely simple and inexpensive, yet rugged and reliable dimmer switch is provided.

It will be apparent that this dimmer switch structure can be used for any voltage control operation wherein the operation of the potentiometer or rheostat through the rotation or other motion of an operating shaft causes the operation of any desired control circuit to control a triac or anti-parallel connected thyristors or other device which might be used.

BRIEF DESCRIPTION OF THE DRAWINGS

FIG. 1 is an elevational view of the interior surface or surface facing the mounting plate of the rheostat insulating housing of the invention;

FIG. 6 is a cross-sectional view of FIG. 1, taken across the section line 6—6 in FIG. 1;

FIG. 7 is a cross-sectional view of the housing of FIG. 1, taken across the section line 7—7 in FIG. 1;

FIG. 14 is an elevational view of the exterior surface, relative to the switch housing of the yoke or conductive mounting plate for the switch;

FIG. 15 is a side view, partially in cross-section, of the mounting plate of FIG. 14.

FIG. 16 is a plan view greatly enlarged of a spring contact which is used in the switch housing of FIGS. 10 through 13;

FIG. 17 is a bottom view of the spring contact of FIG. 16;

FIG. 18 is an elevational view of one of the resistor contacts which is to be mounted within the rheostat housing of FIGS. 1-12;

FIG. 19 is a side view of FIG. 18 as seen from the right-hand side of FIG. 18;

FIG. 20 is a top view of FIG. 19;

FIG. 21 is a plan view of the rheostat rotor which is to be mounted in the rheostat housing of FIGS. 1 through 13 and which is engaged by two fixed contacts of the type shown in FIGS. 18, 19 and 20.

FIG. 22 is a front elevational view of the index cam which is to be mounted within the switch housing of FIGS. 8 through 13.

FIG. 23 is a side view of th index cam of FIG. 22.

FIG. 24 is a cross-sectional view showing a detail in cross-section of the cam surface for the cam of FIGS. 22 and 23.

FIG. 25 is an elevatioal view of the conductive spider which is fitted over the spider of FIGS. 22, 23 and 24.

FIG. 26 is a side view of the spider of FIG. 25.

FIG. 27 is a detailed view of one of the legs of the spider of FIG. 25.

FIG. 28 is a side view of FIG. 27.

FIG. 35 shows the subassembly of the switch housing of FIGS. 8 through 13 with the index cam of FIGS. 22-24 and the spider contact of FIGS. 25-28 along with two spring contacts of the type of FIGS. 16 and 17.

FIG. 36 is a cross-sectional view of the operating components of the switch of FIGS. 1-34 except for the contacts of FIGS. 16-20.

FIG. 38 is an elevational view of the rear surface of the mounting plate with all parts assembled behind the mounting plate.

FIG. 39 is a cross-sectional view of FIG. 38 taken across the section line 39-39 in FIG. 38.

FIG. 40 is a cross-sectional view of FIG. 38 taken across the section line 40—40 in FIG. 38.

FIG. 41 is a cross-sectional view of FIG. 38 taken across the section line 41—41 in FIG. 38.

FIG. 42 is a cross-sectional view of FIG. 38 taken across the section line 42—42 in FIG. 38.

FIG. 43 is a cross-sectional view of FIG. 39 taken across the section line 43—43 in FIG. 39.

FIG. 44 is an electrical circuit diagram showing the novel dimmer switch of the invention in connection with a power source and a lamp load.

DETAILED DESCRIPTION OF THE DRAWINGS

Figure 5:
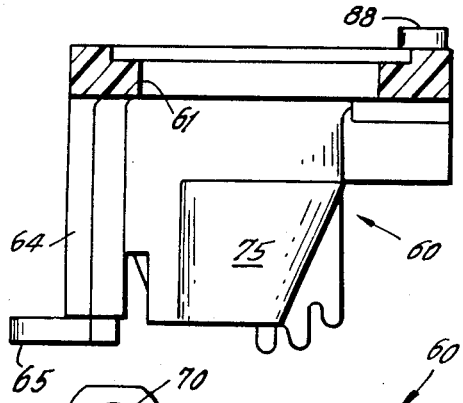
FIG. 5 is a top view of FIG. 3, partially in cross-section.

Referring first to FIGS. 1-7, there is shown therein the molded rheostat housing 60 which is employed in the novel device of the invention. Housing 60 can be molded by any molding process and can be of any desired material having the necessary mechanical and electrical characteristics needed for the switch application.

An opening 61 is formed in the main wall of housing 60 (FIGS. 1, 3 and 5) and can receive a neon lamp for night lighting, if such a feature is desired.

An integral cavity portion 62 in housing 60 will receive a standard non-isolated triac and will press the triac heat sink into thermal contact with the yoke of the switch as will be later described. Cavity 62 contains an integral extending post 63 (FIGS. 1, 2, 3 and 4) which may receive a spring which presses on the heat sink tab of the conventional triac device which is employed as the main switching device.

Housing 60 then has a perpendicular wall 64 extending from the main body thereof which has extending alignment ears 65 and 66 which will be later seen to be used for automatic aligning and securement of housing 60 to the switch housing section. The main body of housing 60 is further provided with main mounting openings 70, 71 and 72 which receive fastening devices such as metal eyelets or rivets for fixing the sub-assembled insulation housings to the mounting plate when assembling the switch.

There is next provided in housing 60 a generally conical projection 75 which has a conical interior surface which has an opening 76 therethrough. A biasing springreceiving annular channel 76*a* surrounds the base of opening 76. The operating shaft of the switch extends through opening 76, as will be later described. Note that the conical opening extending through conical section 75 has an elongated slot 78 in one surface thereof (FIGS. 1 and 7). This slot permits a collar pawl to extend through the exterior of housing 60 to engage the indexing cam of the adjacent switch housing, as will be later described. Also provided within the conical opening is an internal ridge 85 which is used for positioning the collar pawl to be later described.

There is next provided two square elongated openings 80 and 81 which communicate with resistor contact slot 82 and 83, respectively (FIG. 1) which fix the wiping contact portions of the resistor contacts to be described immediately below the resistive pattern on the rotatable resistor plate which is mounted on surface 77.

The rear surface of housing 60 contains a projection 88 which projects from the otherwise flat rear surface. Projection 88 is a keying projection which fits into a corresponding opening on the conductive mounting plate, as will be later described.

There is next described the insulated switch housing portion 90 of the switch device, as shown in FIGS. 8–13. Switch housing 90 is a molded housing of the same material as housing 60. Housing 90 has a central integral projecting post 91 which rotatably receives an indexing cam, as will be later described, and also is provided with integral posts 92, 93, 94 and 95 which assist in fixing main contact spring wipers in place within the housing, as well be later described. To end walls 96 and 97 of the housing are provided with integral slots 98–99 and 100–101, respectively, which slots permit the side mounting of the contact springs as will be later described.

There is next provided on the outwardly facing surface of housing 90 relative to the yoke a pair of projections 105 and 106 which, during the subassembly of the housings, will fit into the openings in ears 65 and 66 of the rheostat housing 60 in order to fix the two housings in position relative to one another. Also provided on the other surface of the switch housing 90 are elongated projections 107 and 108 which fit into corresponding elongated slots in the yoke to align and fix the switch housing relative to the support plate when the switch is assembled. There is also provided around the post 91 in the housing 90 a projecting ring 110 (FIGS. 8 and 12) which serves as a bearing surface for the indexing cam.

There is next described in FIGS. 14 and 15 the conductive mounting plate or yoke 120 upon which the switch components are mounted. The yoke 120 shown is for a 600 watt size dimmer structure. The yoke 120 consists of an aluminum plate having a thickness of, for example, 0.063 inches. Yoke 120 has two offsets 121 and 122 at its upper and lower end, respectively. The offsets contain respective elongated mounting openings 123 and 124 which permit the mounting of the switch assembly in a conventional wall box.

A central opening 125 is formed in yoke 120 and has a slight bushing like extension 126 which will receive the operating shaft of the dimmer switch as will be later described. Also provided are threaded openings 127 and 128 which will receive the screws of the conventional wall cover plate which is used to cover the front of yoke 120 120 after its installation in a wall box. There are next provided for yoke 120, three openings 130, 131 and 132 which, as will be later seen, receive eyelets which pass through openings 70, 71 and 72, respectively, of housing portion 60 in order to secure the housings to the yoke 120.

The yoke 120 next contains an opening 135 which receives projection 88 of housing 60 to align the housing 60 relative to the yoke 120 during assembly. Next provided in the yoke 120 are elongated slots 140 and 141 which receive projections 107 and 108, respectively, of the switch housing 90 during the assembly of the device in order to automatically align the switch housing with the yoke 120. There are finally provided in the yoke 120 four openings 142, 143, 144 and 145 which are used to receive the mounting screws or rivets for securing a conventional insulation cover over the switch components which are mounted on the yoke 120.

There is next described in FIGS. 16 and 17 a switch contact 150 which is of thin cartridge brass spring material. The contact can, for example, have a thickness of about 0.012 inches and has an extending terminal head 151 and an elongated body 152 which is separated into two fingers by the slot 153. Two such contact springs are employed and are mounted in the switch housing 90, as will be later described.

There is next described in FIGS. 18, 19 and 20 one of two resistor contacts 160 which are used in accordance with the invention. Resistor contact 160 has a rectangular body portion 161 dimensioned to fit into slots 80 and 81 in the potentiometer housing 60. The resistor contact is made of a stamped cartridge brass and has a thickness of about 0.015 inches. Contact 160 has a projecting wiper leg 162 which is terminated with a depressed contact type cup 163, the outer surface of which makes sliding contact with the resistance plate to be described later.

There is next shown in FIG. 21 a plan view of the rotatable variable resistor plate 170. Plate 170 may be about 0.030 inches thick and consists of any desired insulation material and can have a diameter, for example, of 0.820 inches. Plate 170 has a central opening 171 which has a projecting keying notch 172 which is received in a keying slot in the adjustment shaft so that plate 170 is rotated with the rotation of the adjustment shaft of the dimmer, as will be later described. A conventional resistive material is then deposited onto the surface of the plate 170 with a novel pattern consisting of outer and inner rings of resistive material 172 and 173, respectively, joined at one of their ends 174. In a particular design, the total resistance between the free ends of rings 172 and 173, is about 350 kilo ohms. The individual rings 172 and 173 are arranged to be contacted by two identical resistor contacts 160, as will be later shown, so that the resistance between the two contacts will be related to the angle of rotation of the plate 170.

There is next described the structure of the index cam 180, shown in FIGS. 22, 23 and 24. Cam 180 can be molded from any suitable plastic. Cam 180 has a central opening 181 which will later be shown to telescope over the post 91 of the switch housing. The outer surface of the cam has four lobes 182, 183, 184 and 185, each consisting of three surface segments, such as the surface segments 186, 187 and 188 for the lobe 182. The surface segment, such as segment 188, is the support surface for the conductive segment of a spider contact to be later described in connection with FIGS. 25–28.

One side surface of index cam 180 contains a plurality of cam teeth projections best shown in FIG. 22 as projections 190 through 197. The extending cam projections 190 through 197 will be later described as receiving the operating pawl of a collar which is axially moved with the shaft of the switch in order to open and close the air gap switch of the dimmer. Cam 180 is further provided with a short extension 200, as seen in FIG. 23, on the surface opposite to the surface containing the cam projections 90–97.

There is next described the spider contact 205 which is carried on the index cam of FIGS. 22, 23 and 24. Spider contact 205, as shown in FIGS. 25 and 26, consists of a conductive web 206 having four perpendicularly projecting fingers 207, 208, 209 and 210 which are each angularly displaced from the radius of a circle drawn around the center of the web 206. Details of the typical projecting section 210 are shown in FIGS. 27 and 28. As will be later described, the spider contact 205 fits over the index cam 180, as shown for example in FIG. 22, wherein each of the spider contact legs 207–210 fit over a corresponding lobe section of the cam and particularly are supported on the lobe section 188 for example of lobe 182 and the similar lobe sections of lobes 183, 184 and 185. The subassembly of the cam 180 and spider 205 is illustrated in FIGS. 35 and 36 where it is seen that each leg extends only about one-half the distance of the length of its corresponding lobe. This produces an air gap between the inner surfaces of legs 207–210 and the surfaces of the underflying shelf portions of each lobe to assist in extinguishing contact arcing and prevent carbonization of the underlying plastic.

Figure 31:
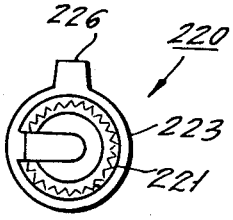
FIG. 31 is an end view of the shaft of FIG. 29 when seen from the right-hand end of the shaft.

There is next described the operating shaft 220 which is shown in FIGS. 29–32. Shaft 220 consists of an external knurled portion 221, an elongated shaft portion 222, an extending collar 223 and contains an elongated keying slot 224 which keys into the rotatable resistor plate previously described. There is also provided a partial slot 225 on the side of the shaft opposite to slot 224. There is next provided an extending tab 226 which extends from the collar 223 as shown in FIG. 31. The shaft portion extending from collar 223 will later be seen to be external of the potentiometer housing.

Figure 33:
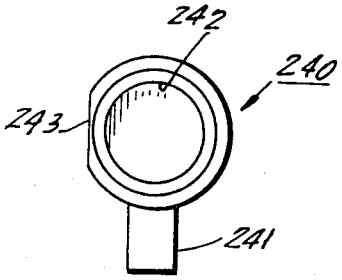
FIG. 33 is an elevational view of the operating collar which is fitted around the operating shaft of FIG. 29 and which operates the index dam of FIGS. 22, 23 and 24 upon depression of the shaft of FIGS. 29, 30, 31 and 32.
Figure 34:
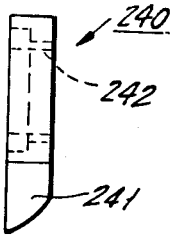
FIG. 34 is a side view of the collar of FIG. 33.
Figure 37:
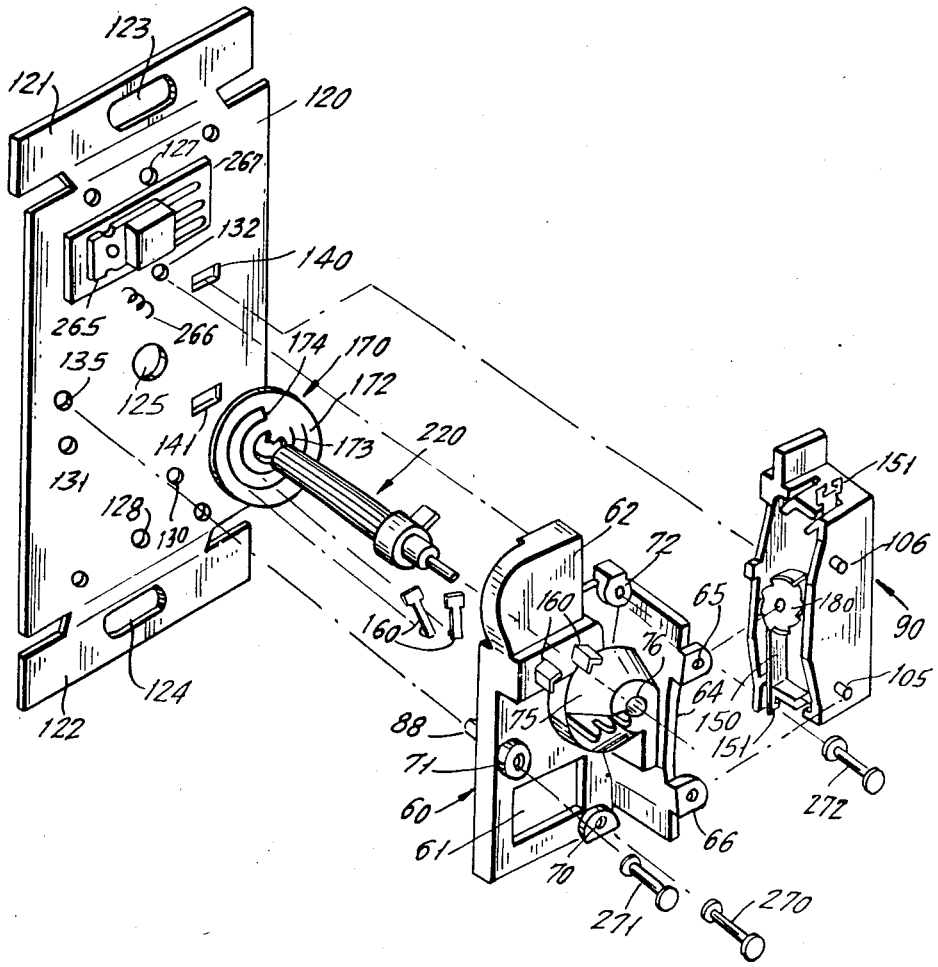
FIG. 37 is an exploded perspective view showing the relationship of the potentiometer housing and switch housing relative to the metal mounting plate of yoke.

There is next described the collar 240 which is shown in FIGS. 33 and 34. Collar 240 contains the operating pawl 241 for operating the cam projections 190–197 of the index cam 180. Collar 240 may be made, for example, of nylon and has a central opening 242 which receives the shaft portion 230 of the operating shaft 220 and seats on the collar 223 of the shaft. A flat 243 is formed on the outer surface of the collar.

The manner in which the switch is assembled can now be described with reference particularly to FIGS. 35–43. The components for the switch housing may first be subassembled as shown in FIG. 35. Thus, the spider 205 is first pressed over the index cam 180. The subassembled spider 205 and cam 180 are then placed on the central post 91 of the housing 90. The internal opening of cam 180 is closely fitted onto post 91 but rotates about post 91 without excessive frictional retarding force. Note that the bottom of the web 206 of spider 205 rotates over the annular bearinglike protrusion 110 shown in FIG. 12 of the housing 90. The index cam 180 and spider 205 are therefore free to rotate around the post 91 with relatively low frictional retarding force.

Two contact strips 150 are then inserted through slot 100 and over post 94 and through slot 99 and under post 93, respectively in FIG. 35. The configuration of the posts and slots are such that the biasing force applied to the contacts 150 tends to bow one contact 150 downwardly and the other contact 150 upwardly in FIG. 35. Thus, the contact strips 150 are side mounted in the housing 90 and are retained in the housing due to the frictional forces caused by the flexure of the contact strips while the strips are pressed into high pressure contact with spider 205 or cam 180 to hold the cam 180 in place against accidental or unintended rotation. That is, the free ends of the contact strips within housing 90 are resiliently biased against the lobes of cam 180 or against the conductive legs of the spider 205, depending upon the angular position of the cam 180. Thus, in the position shown in FIG. 35, the two contacts firmly engage the insulation surface of two lobes of the index cam 180 and the contact segments of the spider contact 205 are not contacted. If, however, the cam 180 is rotated clockwise, a position will be reached at which the free ends of contacts 150 will engage respective legs of the spider 205 in order to form a direct electrical connection between the terminal ends 151 of the two contacts 150. Note that contacts 150 are further flexed when they engage contact segments of contact 205 to further increase the contact pressure. This structure then defines the air gap switch for the dimmer switch of the invention.

Figure 3:
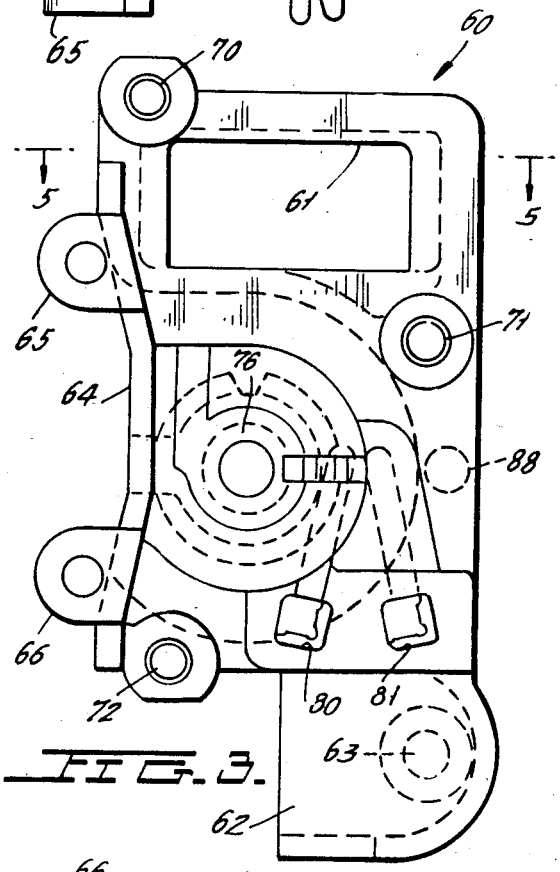
FIG. 3 is an elevation view of the outside surface of the potentiometer housing of FIGS. 1 and 2 and is also a view of the left-hand side of FIG. 2.
Figure 2:
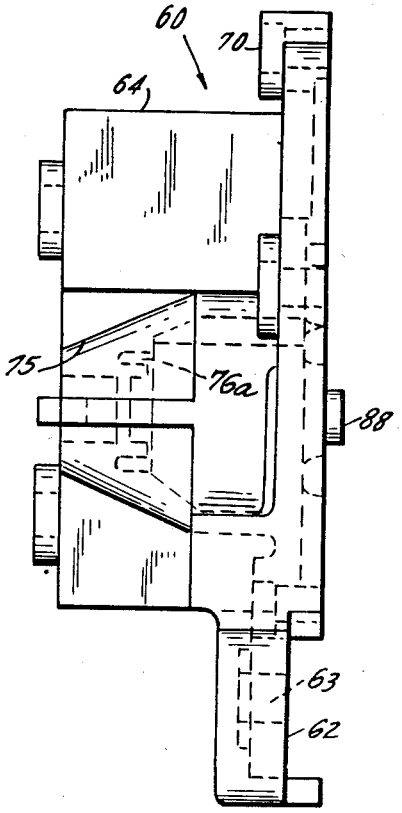
FIG. 2 is a side view of FIG. 1 as seen from the left-hand side of FIG. 1.
Figure 4:
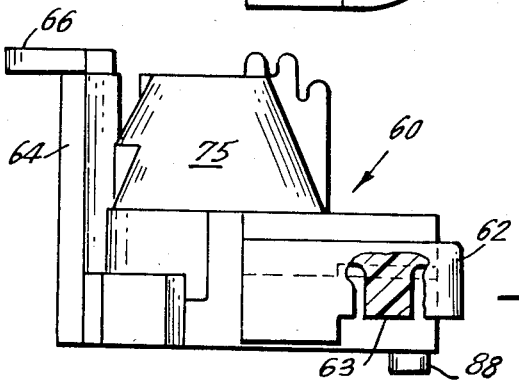
FIG. 4 is a bottom view of FIG. 3 partially in cross-section.
Figure 10:
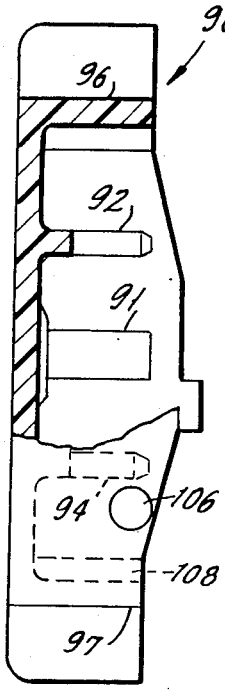
FIG. 10 is a side view of FIG. 8 partially in cross-section, as seen from the left-hand side of FIG. 8.
Figure 8:
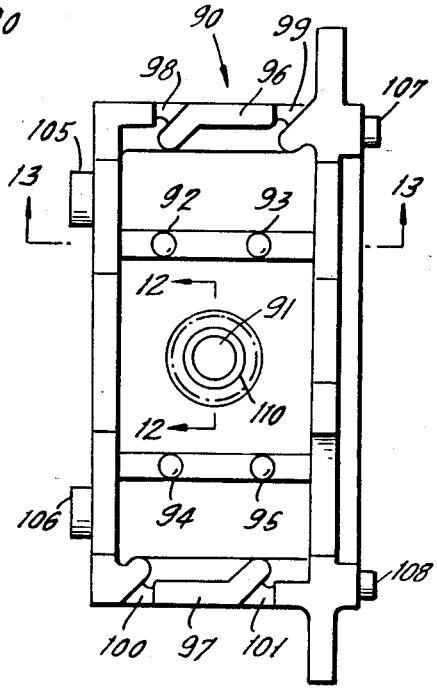
FIG. 8 is an elevation view of the switch housing of the invention when seen from the inside surface thereof or the surface which faces the rheostat housing.
Figure 9:
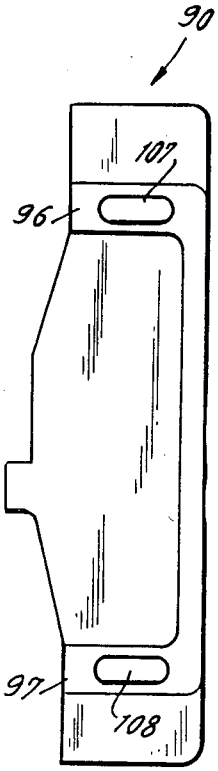
FIG. 9 is a side view of FIG. 8 as seen from the right-hand side of FIG. 8.
Figure 11:
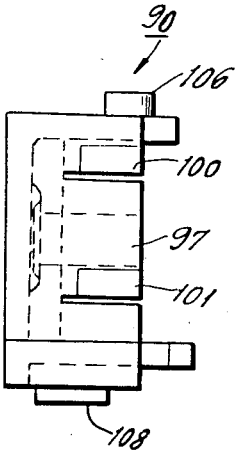
FIG. 11 is a bottom view of FIG. 10.
Figure 13:
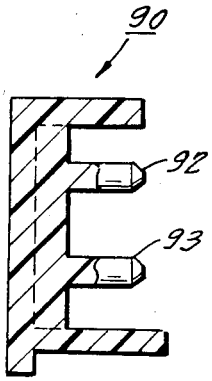
FIG. 13 is a cross-sectional view of FIG. 8, taken across the section line 13—13 in FIG. 8.
Figure 12:
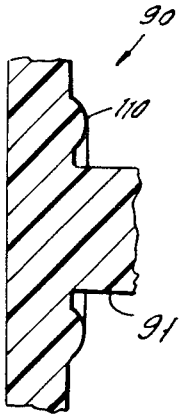
FIG. 12 is a cross-sectional view of FIG. 8; taken across the section line 12—12 in FIG. 8.
Figure 29:
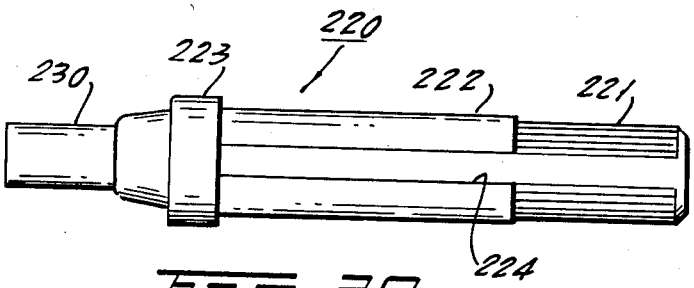
FIG. 29 is a plan view of the rotatable operating shaft which is to be assembled within the potentiometer housing of FIGS. 1-7.
Figure 30:
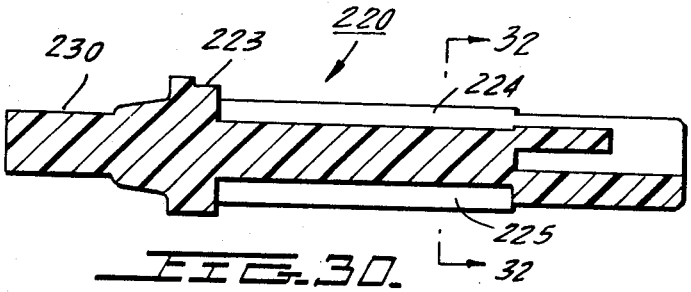
FIG. 30 is a cross-sectional view of the shaft of FIG. 29 taken along the axis of the shaft.
Figure 32:
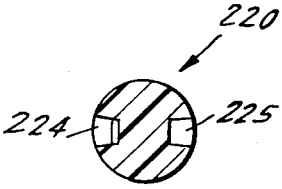
FIG. 32 is a cross-sectional view of FIG. 30, taken across the section line 32—32 in FIG. 30.

The next components to be subassembled are those shown in FIG. 36, including some of the parts which are contained by the rheostat housing 60. The resistor contacts 160 are first loaded into rectangular through-openings 80 and 81 (FIG. 3). There is next loaded into the housing a biasing spring 260 which fits into the annular slot 76*a* of housing 60, followed by the collar 240, the shaft portion 230 of the shaft 220 and the variable resistor plate 170. When loading the variable resistor plate 170 over shaft 220, it will be noted that the surface of the plate 170 containing the resistive pattern will automatically contact resistor contact sections 163 of the flexible legs 162 of the resistor contacts 160. Note that the collar 241 must be assembled with the correct orientation and with the surface of pawl 241 facing in the correct direction because it is only with this orientation that the flat 243 of collar 241 will face rib 85 (FIG. 1) of the housing 60. Note also that the pawl portion 241 of the collar must be disposed in the slot 78 of housing 60 and that it projects slightly beyond the outer surface of housing 60.

A conventional, non-isolated triac 265 shown in FIGS. 37, 39, 41 and 43 is loaded into cavity 62 of housing 60. A biasing spring shown in FIG. 37 as the biasing spring 266 is compressed between the interior of the cavity 62 and the conductive tab of triac 265 with the post 63 extending through the center of the spring 266. Note that the conductive heat sink tab of triac 265 is electrically insulated from the yoke 120 as by a thin electrical insulation tape 267 which is fixed to the surface of the yoke 120. Tape 267 is a conventional electrical insulation tape which is sufficiently thin as to not interfere with heat transfer from the triac 265 to the yoke 120.

Thereafter, the subassembled switch housing of FIG. 35 is put in position relative to the yoke 120 with the projecting alignment pins 107 and 108 of the housing 90 (FIGS. 8 and 9) entering corresponding slots 140 and 141 in the yoke 120. The subassembled rheostat housing 60 is then fitted onto the yoke 120 with its alignment pin 88 entering alignment opening 131 and with the ears 65 and 66 enveloping over alignment pins 106 and 105, respectively, of housing 90.

During this assembly process, spring 266 above the triac 265 is compressed between yoke 120 and housing 60, thereby to press the triac heat sink tab into firm mechanical and thermal contact with the tape 267 and the underlying yoke 120. The subassembled parts are then fixed in position by fasteners, such as eyelets or rivets 270, 271 and 272 shown in FIG. 37 which extend through openings 70, 71 and 72, respectively, in housing 60 and corresponding openings 130, 131 and 132 in the yoke 120.

Thereafter, the three terminals of the triac 265 are appropriately interconnected with the terminals of resistor contacts 160 and the switch contacts 150 of FIG. 35. A suitable phase control circuit (shown in FIG. 44) is also fixed in place for control of the gate circuit of the triac 265.

In the mechanical arrangement for mounting the triac 265, it will be noted that the triac is a non-isolated device in that its heat sink tab is electrically continuous with one main terminal of the device. Thus, the triac is relatively inexpensive. The mechanical clamping of the triac on the yoke 120 which acts as a heat sink by conductive eyelets 270, 271 and 262, is possible since they are electrically insulated from the triac tab by the rheostat housing 60, which is of insulation material. Consequently, it is possible to use a triac having a non-isolated tab and further, it is not necessary to use special insulation sleeving or the like or non-conductive materials for the eyelets which hold the components in place. Note also that with the novel structure of the invention, the resistor contacts 160, shown in FIG. 43, are used as holding, locating and electrical contact points for electrical control components (not shown) but connected through lead 16*a* in FIG. 43 and the contact or power leads of the housing. All switch components and the insulation housings are then enclosed by a conventional insulation cap 300, as shown in FIGS. 39 to 43.

In order to operate the air gap switch, it is necessary only to depress shaft 220, which may have an operating knob 301 thereon as shown in FIG. 40, against the force of biasing spring 260. The depression of the shaft 220 as shown, for example, in FIG. 23, will cause the collar pawl 241 to contact an aligned surface protrusion of the index cam 180 such that continued motion of the shaft 220 in an axial direction will cause the index cam 180 to rotate until the spider contact 205 rotates to the next index position. The next index position, in the case of FIG. 35, will be the contact-on position in which contacts 150 will engage the legs extending from the contact spider 205. When the shaft 220 is released, spring 260 will return the shaft to the position of FIG. 36 and, upon a subsequent depression of the shaft, the index cam 180 will again rotate to open the circuit between contacts 150 in FIG. 35.

The circuit which is formed by the novel switch of the invention is shown in FIG. 44. Referring to FIG. 44, there are shown two power line a-c terminals 310 and 311 which are connected in series with a lamp load 312, for example, and then to the power line conductor terminals 312 and 313 of the switch subassembly. The power line terminals 312 and 313 are connected in series with the two contacts 150 in the switch housing, wherein these two contacts are electrically connectable in a bridge-type connection by the spider contact 205 when appropriately moved by the shaft 220. The circuit then continues in series with the triac 265 to the power line conductor 313 of the dimmer switch assembly.

A control circuit 314 which may be of any known desired type circuit employed for control of power semiconductors, is then provided and is suitably contained at any desired location within the dimmer assembly previously described. Output power for the control circuit 314 can be derived from the power leads 312 and 313. Control circuit 314 includes resistor contacts 160 which are slidably connected to the resistive pattern on rotatable resistor plate 170. As the plate 170 is rotated by rotation of the shaft 220, the input resistance to the control circuit varies in order to vary the point in the half wave at which the triac 265 is fired, thus producing any desired controlled dimming condition for the lamp 312.

Althrough the present invention has been described in connection with a number of preferred embodiments thereof, many variations and modifications will now become appaent to those skilled in the art. It is preferred, therefore, that the present invention be limited not be the specific disclosure herein, but only by the appended claims.

What is claimed is:

1. A voltage control switch having a generally flat conductive yoke plate, a power semiconductor device having main power terminals and a control terminal and having an electrically active conductive heat sink, an insulation housing having an integral cavity for receiving said power semiconductor device with the surface of said heat sink facing outwardly of said housing, a thin electrically insulating member disposed on said yoke and disposed between and electrically insulating said yoke and said heat sink surface, and at least one conductive fastener connected to said yoke and to said insulation housing for fixing said housing to said yoke and for pressing said power semiconductor device into firm engagement with said thin insulating member and into good thermal contact with said yoke.

2. The voltage control switch of claim 1, which further includes manually movable control means coupled to said control electrode for varying the conduction time of said power semiconductor device.

3. The voltage control switch of claim 2, wherein said power semiconductor device is a triac.

4. The voltage control switch of claim 1 which further includes biasing spring means disposed between the bottom of said cavity and said power semiconductor device.

5. A voltage control switch capable of being mounted in a wall box comprising, in combination: a molded plastic potentiometer housing containing and supporting a rotatable and axially movable operating shaft and a variable resistor structure coupled to said shaft, whereby the resistance of said variable resistor structure is varied in response to the rotation of said shaft; a conductive generally flat yoke; power semiconductor means connected in thermal exchange relation with respect to said yoke; said variable resistor structure being electrically coupled to said power semiconductor means to vary the conduction time of said power semiconductor means in response to rotation of said shaft; and connection means connecting said potentiometer housing to said yoke with said shaft extending through an opening in said yoke.

6. The switch of claim 5, wherein said power semiconductor means has an electrically active conductive heat sink, and wherein said potentiometer housing contains a cavity for receiving said power semiconductor means and for holding said power semiconductor means heat sink adjacent the surface of said yoke; and a thin insulation sheet disposed between said yoke and said active conductive heat sink power semiconductor means.

7. The switch of claims 5 or 6, wherein said variable resistor structure includes a plate having a circular resistance pattern on the surface thereof and a wiper contact means for making sliding contact with said resistance pattern; said plate being rotatable about its axis and being fixed to rotate with said shaft; said wiper contact means being stationarily mounted within said potentiometer housing.

* * * * *